United States Patent [19]

Cohen et al.

[11] Patent Number: 4,969,564

[45] Date of Patent: Nov. 13, 1990

[54] BABY BOTTLE WITH NIPPLE AND FLEXIBLE STRAW

[76] Inventors: Joel Cohen; Esther R. Cohen, both of 1020 NW. 99th Ave., Plantation, Fla. 33322

[21] Appl. No.: 398,410

[22] Filed: Aug. 25, 1989

[51] Int. Cl.[5] ..... A61J 9/00; A61J 9/08; A61J 11/04

[52] U.S. Cl. ..... 215/11.1; 215/11.4; 215/11.6

[58] Field of Search ..... 215/11.1, 11.4, 11.5, 215/11.3, 11.6

[56] References Cited

U.S. PATENT DOCUMENTS

| | | | |
|---|---|---|---|
| 224,557 | 2/1880 | Potter | 215/11.1 |
| 227,075 | 4/1880 | Thompson | 215/11.1 |
| 468,759 | 2/1892 | Bobrick | 215/11.1 |
| 514,974 | 2/1894 | Turck | 215/11.1 |
| 593,830 | 11/1897 | Borgenschild | 215/11.1 |
| 2,655,279 | 10/1953 | Wolf | 215/11.1 X |
| 3,044,650 | 7/1962 | Oltion et al. | 215/11.1 |
| 3,076,574 | 2/1963 | Woodbury, Jr. | 215/11.1 |
| 3,441,160 | 4/1969 | Levy | 215/11.1 |
| 3,704,803 | 12/1972 | Ponder | 215/11.4 X |
| 4,463,859 | 8/1984 | Greene | 215/11.1 |

FOREIGN PATENT DOCUMENTS

| | | | |
|---|---|---|---|
| 208564 | 3/1909 | Fed. Rep. of Germany | 215/11.1 |
| 82 9636 | 7/1938 | France | 215/11.1 |
| 9806 | 7/1887 | United Kingdom | 215/11.4 |
| 740189 | 11/1955 | United Kingdom | 215/11.1 |
| 1253398 | 11/1971 | United Kingdom | 215/11.4 |
| 2067416 | 7/1981 | United Kingdom | 215/11.4 |

*Primary Examiner*—Sue A. Weaver

*Attorney, Agent, or Firm*—Malloy, Downey & Malloy

[57] ABSTRACT

A baby bottle assembly having a nipple which is mounted on a flexible straw extending from the bottle such that in the preferred embodiment, the straw is disposed within the interior of the bottle with a substantial portion of the straw extending exteriorly of the bottle and having a nipple structure mounted on the end, such that a baby can feed from the bottle in an upright position without the need of having to invert the bottle to facilitate fluid flow to the nipple and further, wherein a one-way valve structure is mounted on the end of the straw within the nipple assembly to permit fluid flow in an outward direction from the bottle while preventing air from entering the bottle through the flexible straw.

12 Claims, 2 Drawing Sheets

BABY BOTTLE WITH NIPPLE AND FLEXIBLE STRAW

BACKGROUND OF THE INVENTION

1. Field of the Invention

This invention relates to a baby bottle assembly having a flexible straw extending therefrom wherein the flexible straw includes an outer free-end having a one-way valve and nipple structure mounted thereon.

2. Description of the Prior Art

The use of baby bottles having a nipple mounted on the opening has been known to the consuming public for many years. The baby bottles which exist in the prior art include a nipple structure which is commonly mounted to the bottle opening through the use of a threaded collar which supports the nipple and threadably engages the opening of the baby bottle. In such a manner, the nipple structure can be detached from the bottle when empty and a new supply of fluid can be replaced for the next feeding.

A common problem associated with most baby bottles in the prior art is the need to prevent air from coming through the nipple while the baby is feeding. If too much air is taken in during feeding, the baby may suffer a great amount of discomfort caused by trapped gas. To prevent this from happening, the bottle has to be held in an inverted position so that the fluid in the bottle surrounds the nipple at the bottle opening and any air in the bottle is displaced towards the base of the bottle thereby reducing the amount of air which is taken in through the nipple. However, it is often difficult to feed the baby with the bottle in an inverted position, especially when the baby is seated upright in a chair while riding in a car or watching TV. In this instance, the baby bottles commonly found in the prior art require that the baby's head be tilted back sufficiently to allow the bottle to be held in an inverted position. Because babies are often fidgety and difficult to keep still, it is often impossible to feed the baby when he or she is seated in an upright position. Accordingly, there is a need in the prior art for a baby bottle and nipple assembly which a young child can hold in his lap in a vertical position when the child is seated upright watching TV or riding in a car.

SUMMARY OF THE INVENTION

The present invention is directed towards a baby bottle and nipple assembly having a flexible straw extending substantially from the bottle wherein the nipple structure is mounted on the end of the straw in spaced relation from the bottle. In this manner, a child can feed from the bottle while holding the bottle in his lap in any preferred position while still maintaining the nipple in his mouth whereupon feeding can be accomplished without the need of holding the bottle over the child's head in an inverted position.

The present invention is further directed towards a baby bottle and nipple assembly including a conventional baby bottle having a flexible straw mounted on the open end of the bottle with a portion of the straw extending substantially away from the bottle and terminating at a distal end. A nipple structure is mounted on the distal end of the flexible straw in spaced relation from the bottle whereupon the nipple can be directed at varying angles while the bottle is held in a vertical position.

An important feature of the present invention is the existence of a nipple fastening means connected to a surrounding collar wherein the nipple fastening means is structured for attachment of the flexible straw to the nipple. The nipple fastening means further includes a threaded fastening surface which is secured to a correspondingly positioned threaded surface of the collar. Both threaded surfaces are disposed in an outwardly spaced relation from the distal end of the flexible straw. The nipple is fitted into the collar and the straw is fitted through the nipple fastening means in such a manner that a distal end of the straw extends through the bottom of the nipple fastening means and engages an inner portion of the nipple.

Another important feature of the present invention is a one-way valve means which is mounted on the distal end of the flexible straw and firmly seated within the nipple. The one-way valve means acts to permit fluid to flow outwardly from the bottle through the straw and out of the nipple when a baby is feeding therefrom, while preventing any air or liquid from entering back through the distal end of the straw and into the bottle.

The present invention further includes a straw connecting means which threadably mounts to the open end of a conventional baby bottle for connecting the flexible straw thereto. The straw connecting means includes at least one water tight seal which surrounds the straw and maintains it in fixed relation to the open end of the bottle while preventing any fluid from leaking therefrom. One embodiment of the present invention includes the straw connecting means having an elongated portion formed of a flexible material and including a second water tight seal fitted around the straw in spaced relation from the first water tight seal. The elongated portion provides greater support to the straw and helps to prevent the straw from being pinched off when being flexed or bent during use.

Naturally, it is well accepted that the dimensions, configurations and overall designs of such nipple and straw structures varies and accordingly, the straw connecting means including the various water tight seals are provided herein in numerous embodiments. Further embodiments of the present invention include varying the straw length within the bottle from either a position in close spaced relation to the base to a position wherein the straw terminates in close spaced relation to the connecting means at the opening of the bottle. Such a variance in straw length facilitates the flow of liquid through the straw depending on how the bottle is held. If the bottle is held in a vertical position, the straw would be placed in close spaced relation to the base thereby allowing for a maximum quantity of fluid to be withdrawn from the bottle. Further, when the bottle is held in an inverted position, such as when a child is lying down, the end of the straw can be positioned in close relation to the connecting means at the bottle opening.

The present invention accordingly comprises the features of construction, a combination of elements, and arrangement of parts which will be exemplified in the description hereinafter set forth, and the scope of the invention will be indicated in the claims.

BRIEF DESCRIPTION OF THE DRAWINGS

For a fuller understanding of the nature of the present invention, reference should be had to the following detailed descriptions taken in connection with the accompanying drawings in which.

DETAILED DESCRIPTION OF THE PREFERRED EMBODIMENT

Figure 1:
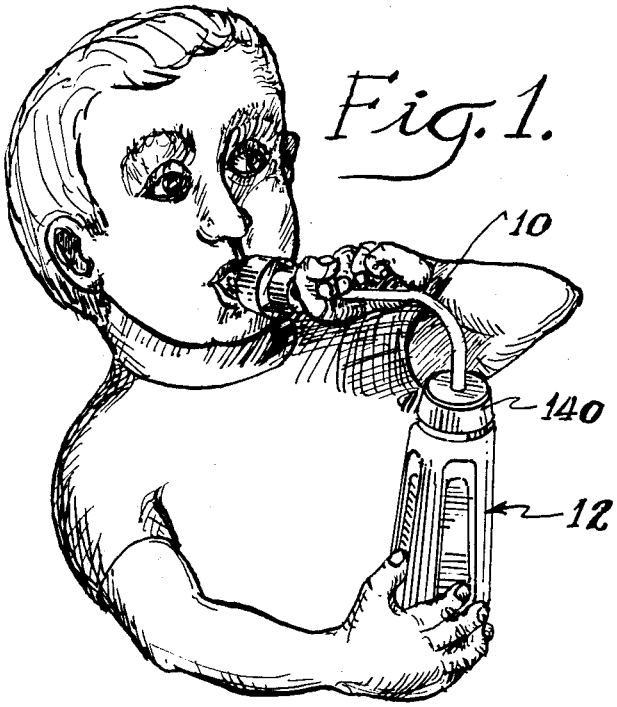
FIG. 1 is a perspective view of the bottle with the nipple and flexible straw assembly illustrating its intended manner of use.
Figure 2:
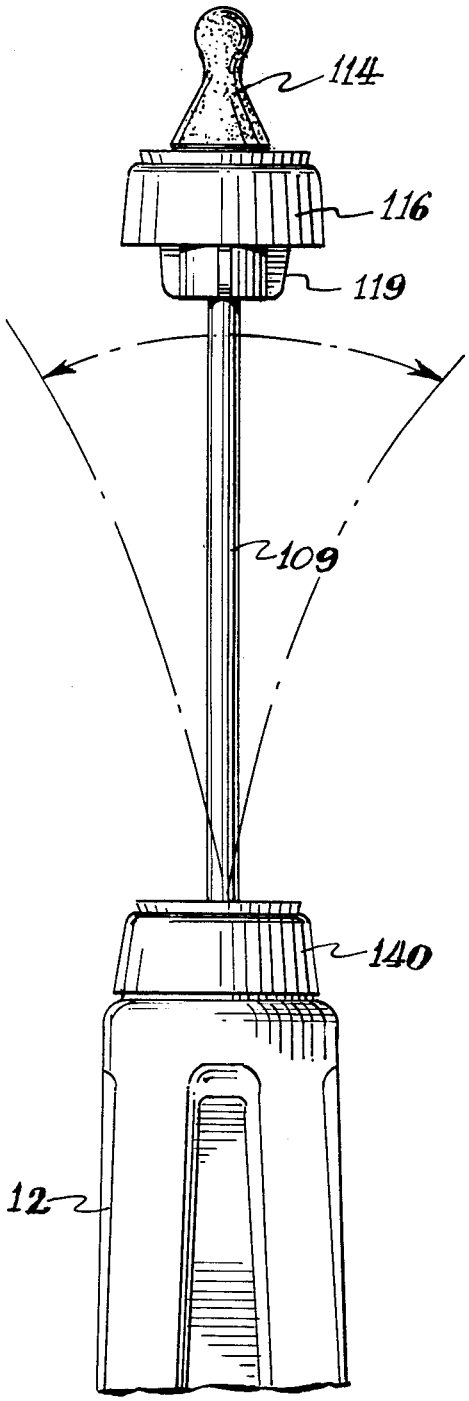
FIG. 2 is a side view of the bottle and nipple assembly illustrating the flexibility of the straw.

Reference is first directed to FIGS. 1 and 2 to illustrate the present invention which is directed towards a baby bottle and nipple assembly having a straw 109 extending from a bottle 12 and connected thereto by straw connecting means 140. A nipple fastening means 119 is mounted on the straw for inter-connection with a nipple 114 and collar 116 (see FIGS. 5 and 6). The present invention is specifically designed to enable a young child to feed from a baby bottle while sitting in an upright position such as watching TV or riding in an automobile, wherein the child would hold the bottle 12 in one hand while grasping the flexible straw in the other hand and bending the straw at 10 to move the nipple towards his mouth for feeding (see FIG. 1).

Figure 4:
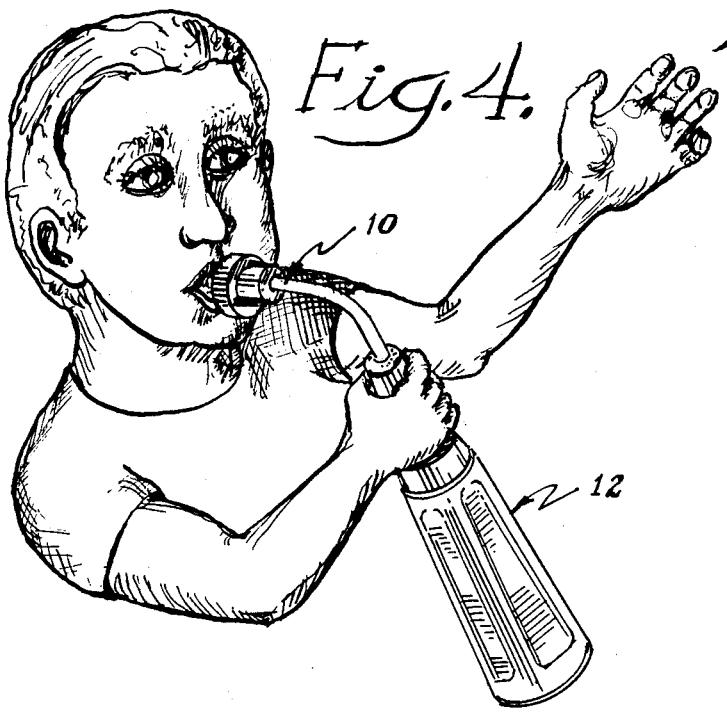
FIG. 4 is a perspective view illustrating an alternative method of holding the bottle during use from that shown in FIG. 1.
Figure 6:
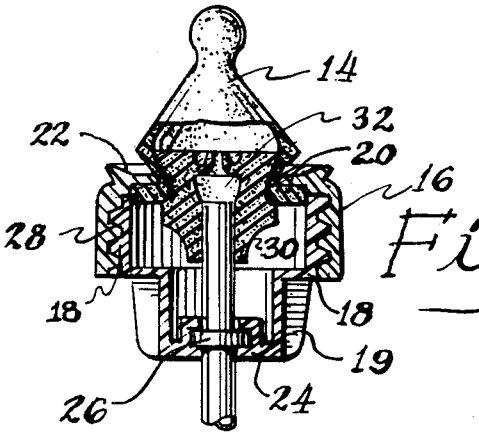
FIG. 6 is a sectional view of the nipple structure in surrounding relation to the distal end of the straw.
Figure 7:
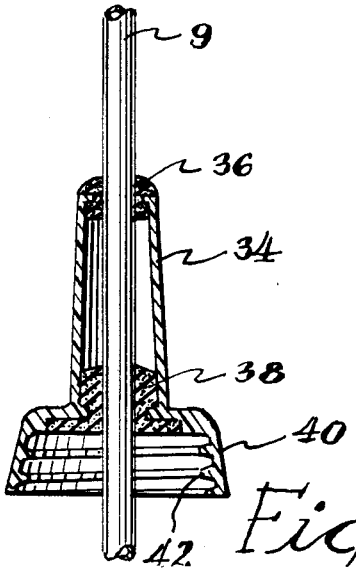
FIG. 7 is a sectional view of the straw connecting means mounted on the bottle of FIG. 5.
Figure 5:
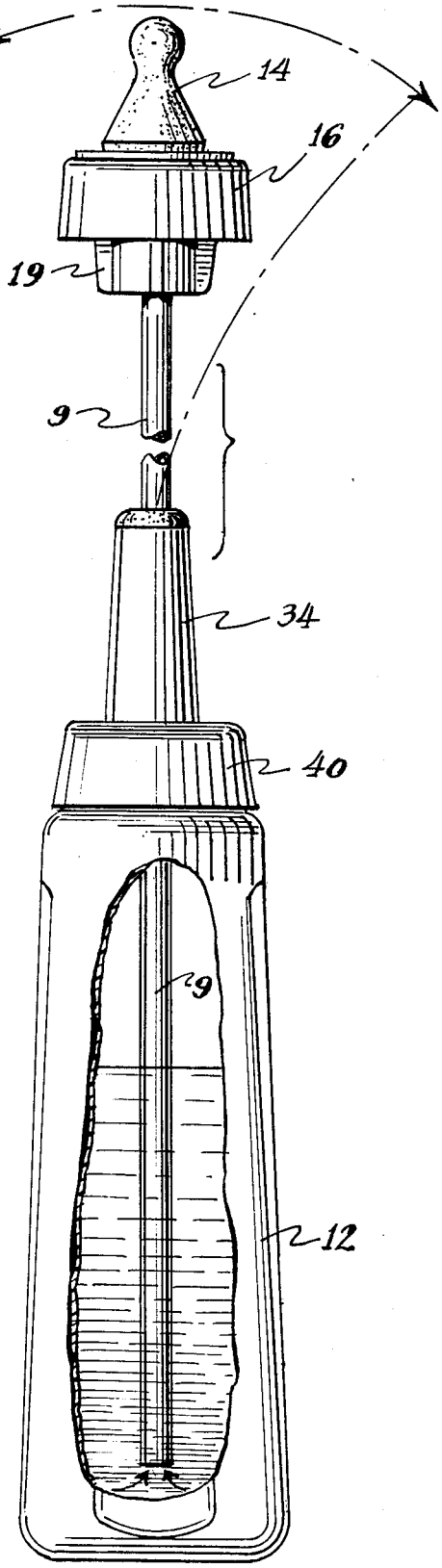
FIG. 5 is a side view in partial cut-away illustrating an alternative embodiment of the straw connecting means and the extension of the straw within the interior of the bottle.

With reference to FIGS. 5 through 7, another embodiment of the present invention is directed towards a baby bottle 12 having a flexible straw 9 extending substantially within the interior of the bottle and being secured thereto by means of a straw connecting means 40. The straw connecting means is shown in detail in FIG. 7 and includes a threaded portion 42 which is threadably secured to the opening of the bottle 12. The particular embodiment shown in FIGS. 4 through 7 includes a straw connecting means having an elongated portion 34 extending substantially along the length of the flexible straw 9 and having a water tight seal 38 in surrounding engagement with the flexible straw at the bottle opening. The embodiment of FIG. 7 shows the elongated portion 34 having a second water tight seal 36 in surrounding engagement with the flexible straw in spaced relation from the first water tight seal 38 wherein both seals act to maintain the straw within the bottle in a water tight manner, and further provide support along the length of the flexible straw 9 to prevent the straw from being offset from its position within the bottle.

FIG. 6 shows the nipple 14 inter-connected to the internally threaded collar 16 by means of a lip portion 20 which fits under the flange 22 along the upper interior surface of the threaded collar 16. The threaded collar 16 is threadably connected to a nipple fastening means 19 which includes an externally threaded portion as at 18 for mating engagement with the internally threaded collar 16, as shown at 28. The flexible straw extends through the bottom of the nipple fastening means and is connected thereto by a stop means 26 on the flexible straw which is receivable within a slot in the retaining member 24 of the nipple fastening means 19. The stop means 26 is defined by a circular disk member which is integrally formed around the flexible straw in spaced relation from its distal end. The retaining member 24 formed on the bottom of the nipple fastening means 19 and includes a circular bore therethrough for passage of the straw, and a slot which is specifically configured to surround the stop means 26 in fixed relation to the flexible straw.

The distal end of the flexible straw includes a one-way valve means 32 which is disposed in the interior of the nipple fastening means and becomes seated within an inner mounting portion 30 of the nipple 14 when the nipple is attached to the nipple fastening means 19. The one-way valve means 32 acts to permit fluid to flow in an outward direction from the bottle and through the nipple into the mouth of a feeding child. The one-way valve means 32 further acts to prevent any air or liquid from entering back through the straw and into the bottle, thereby preventing any excess air or foreign substances from mixing with the fluid contained within the bottle.

The nipple fastening means 19 is mounted in spaced relation from the straw connecting means 40 and elongated portion 34 so as to define a bendable portion 10 as shown in FIGS. 1 and 4. Further, the flexible straw 9, in FIG. 5, can be adjusted to extend through the length of the interior of the bottle 12 so as to be positioned in close relation to the base of the bottle, wherein fluid can flow through the straw while the bottle is held in a vertical position, (see FIG. 5). In this manner, a child can grasp either the bottle 12 or the elongated portion 34 in one hand and, while seated in an upright position, bend the straw with the nipple attached towards his mouth for feeding. With the straw extending through the length of the bottle, there is no need to hold the bottle over the child's head to permit fluid flow through the nipple. If the child desires to be fed while lying down, the flexible straw 9 can easily be adjusted by sliding the flexible straw 9 through the straw connecting means 40 and elongated portion 34 in an outward direction so as to position the end of the straw in close spaced relation from the bottle opening. This will allow a child to hold the bottle in an inverted position, if desired, wherein fluid will readily flow through the straw and to the nipple to facilitate feeding.

Yet another embodiment of the present invention includes the straw connecting means 40 wherein the elongated portion 34 is of a flexible material which further facilitates bending of the straw as illustrated in FIG. 5. In this manner, the straw can be flexed from its upright position with the elongated portion 34 bending with the straw so that the flexible straw does not kink or crease at a point adjacent the second water tight seal 36.

Figure 3:
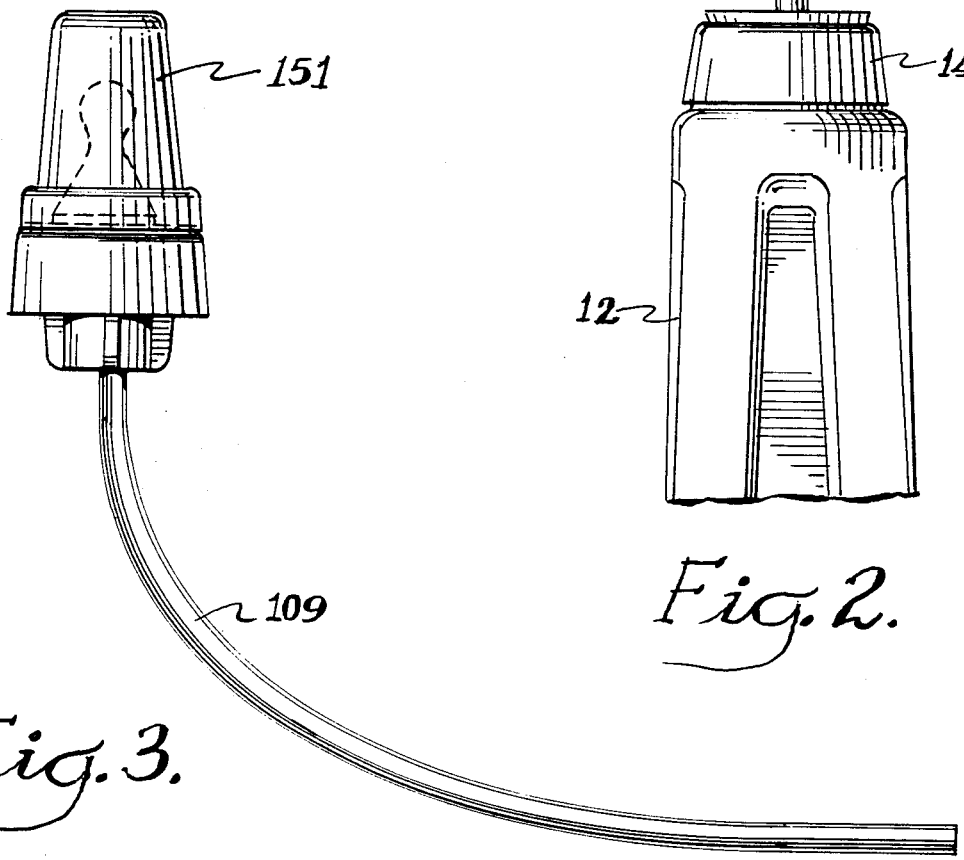
FIG. 3 is a side view in partial section illustrating the flexible straw in connection with the nipple structure including a cap covering the nipple.

Yet another embodiment of the present invention is illustrated in FIG. 3 wherein the nipple and threaded collar include a protective cap 151 for covering the nipple when not in use to prevent bacteria and other harmful germs from forming thereon. The cap 151 may be designed to have an ornamental appearance such as an animal's head, a clown's head or any similar type of animated character. In addition, the straw 9 can be decorated so as to appear as a neck leading from the bottle to the cap 151 which has the appearance of a head.

Now that the invention has been described,

What is claimed is:

1. A baby bottle assembly comprising:

(a) a bottle for containing fluid having an open end and a base, said open end including a threaded portion thereon, (b) a nipple adapted to be received in the mouth of a baby to be fed, and including a mounting portion secured at one end of the nipple, (c) a collar having a substantially hollow interior and connected in surrounding relation to said mounting portion of the nipple, (d) a flexible straw including a first portion extending through the open end of the bottle and terminating at a proximal end, (e) said flexible straw further including a second portion outwardly spaced from said first portion and the open end of the bottle and terminating at a distal end, (f) said flexible straw including an intermediate portion interconnecting said first and second portions, (g) fluid regulating means connected to said distal end and mounted within said collar for regulating fluid flow from said bottle and said distal end being secured to said mounting portion, (h) nipple fastening means removably secured to said collar for fastening said flexible straw to said nipple and including a hollow portion in which said mounting portion and said distal end of said flexible straw are positioned, (i) said nipple fastening means comprising a retaining member spaced from said mounting portion and said distal end and including a retaining slot having a hole extending therethrough and through said retaining member, said hole disposed to establish communication between an interior and an exterior of said nipple fastening means, (j) stop means mounted on said second portion of said flexible straw in spaced relation to said distal end for securing said flexible straw to said nipple fastening means, (k) connecting means mounted on said intermediate portion for connecting said flexible straw to said open end of said bottle, said connecting means being adapted for threaded engagement with said open end and including at least one water tight seal in surrounding and sealing relation to said flexible straw.

2. An assembly as in claim 1, wherein said fluid regulating means includes a one-way valve normally disposed in a closed position being structured and configured to permit fluid to pass therethrough once a baby begins to feed from said nipple.

3. An assembly as in claim 1, wherein said at least one water tight seal of said connecting means includes a lower water tight seal disposed adjacent said open end of said bottle in surrounding and sealing relation to said flexible straw.

4. An assembly as in claim 3, wherein said connecting means further includes an upper water tight seal disposed in spaced relation from said lower water tight seal and in surrounding and sealing relation to said flexible straw.

5. An assembly as in claim 4, wherein said connecting means includes an elongated portionformed of a flexible material and extending substantially along the length of said intermediate portion of said flexible straw.

6. An assembly as in claim 5, wherein said proximal end of said flexible straw is disposed in close spaced relation to the base of said bottle.

7. An assembly as in claim 5, wherein said proximal end of said flexible straw is disposed within said bottle and in close spaced relation to said open end.

8. An assembly as in claim 5, wherein said flexible straw includes a grip zone disposed between said connecting means and said nipple fastening means.

9. An assembly as in claim 1 wherein said collar includes an interior threaded portion spaced outwardly from said mounting portion in surrounding relation thereto, said nipple fastening means including an exterior threaded portion disposed and adapted for removable mating engagement with said interior threaded portion of said collar.

10. An assembly as in claim 1 wherein said mounting portion is structured to surround said distal end and adjacent portion of said flexible straw and said one way valve in fluid relation therewith and said mounting portion defining a path of fluid flow to said nipple.

11. An assembly as in claim 1 wherein said stop means includes a circular disk integrally formed about said second portion of said flexible straw in spaced relation to said distal end said being sized and congruently configured to be supportingly received within said retaining slot of said retaining member.

12. An assembly as in claim 1 further comprising a cap structure specifically dimensioned and configured to frictionally engage and be supported on said collar in surrounding relation to said nipple.

* * * * *